United States Patent [19]

Pesta

[11] Patent Number: 4,481,962

[45] Date of Patent: Nov. 13, 1984

[54] PORTABLE TOILETRY STAND

[76] Inventor: Richard K. Pesta, 5500 Ascot Ct., #120, Alexandria, Va. 22311

[21] Appl. No.: 353,060

[22] Filed: Mar. 1, 1982

[51] Int. Cl.[3] ..... A45D 40/00

[52] U.S. Cl. ..... 132/79 R

[58] Field of Search ..... 132/79 R

[56] References Cited

U.S. PATENT DOCUMENTS

| | | | |
|---|---|---|---|
| 512,101 | 1/1894 | Eastes | 132/79 R |
| 636,537 | 11/1899 | Lippincott et al. . | |
| 1,155,581 | 10/1915 | Kaiser . | |
| 1,281,296 | 10/1918 | Coen . | |
| 1,443,858 | 1/1923 | Windecker | 132/79 R |
| 1,459,181 | 6/1923 | Klebba | 132/79 R |
| 1,500,398 | 7/1924 | Kusnetz | 132/79 R |
| 1,591,515 | 7/1926 | Diskin | 132/79 R |
| 1,867,347 | 7/1932 | Blair . | |
| 1,900,508 | 3/1933 | Lewis | 150/34 |
| 2,014,822 | 9/1935 | Trachtenberg | 150/34 |
| 2,098,160 | 11/1937 | Perritt | 299/96 |
| 2,419,165 | 4/1947 | Renz | 150/34 |
| 2,573,763 | 11/1951 | Graham | 132/79 R |
| 2,685,387 | 8/1954 | Ganay | 222/193 |
| 3,187,757 | 6/1965 | Jones, Jr. et al. | 132/79 R |

*Primary Examiner*—Gregory E. McNeill

*Attorney, Agent, or Firm*—Kinney & Lange

[57] ABSTRACT

A portable folding toiletry stand includes box portion for containing cosmetic fluid dispensers. The dispenser nozzles are mounted to a top wall of the box portion. The box portion rests on a base wall when the dispensers are used. A storage box is hingably attached to an edge of the bottom wall and is movable between a first traveling position wherein the storage box is below the box portion and a second working position wherein the storage box is swung up next to a side wall of the box portion. In the working position, the storage box helps to support the box portion and helps to prevent tipping of the box portion when the fluid dispensers are used. A movable cover protects the fluid dispensers when the toiletry stand is folded for traveling.

9 Claims, 4 Drawing Figures

PORTABLE TOILETRY STAND

BACKGROUND OF THE INVENTION

1. Field of the Invention

The present invention relates to portable folding stands for holding toiletry articles.

2. Description of the Prior Art

Since man began using toiletries to cleanse and maintain his body, he has been searching for efficient and safe ways to carry toiletries when traveling. There has always been a need for a compact device for carrying the latest and modern toiletries which would prevent spilling in suitcases or bags.

A search on the present invention uncovered the following United States Patents:

| Inventor | Ser. No. | Issue Date |
|---|---|---|
| Lippincott et al | 636,537 | 11/7/1899 |
| Ganay | 2,685,387 | 8/3/1954 |
| Perritt | 2,098,160 | 11/2/1937 |
| Kaiser | 1,155,581 | 10/5/1915 |
| Coen | 1,281,296 | 10/15/1918 |
| Lewis | 1,900,508 | 3/7/1933 |
| Renz | 2,419,165 | 4/15/1947 |
| Trachtenberg | 2,014,822 | 9/17/1935 |
| Blair | 1,867,347 | 7/12/1932 |

The following three of these patents show dispensing devices for cosmetics. U.S. Pat. No. 636,537 to Lippincott and Morlok discloses a pneumatic liquid-dispensing jar. U.S. Pat. No. 2,098,160 to Perritt shows an atomizer for cosmetic liquids. U.S. Pat. No. 2,685,387 to Ganay describes a pump for ejecting cosmetic powder from an orifice in a tube. These patents show that pump dispensers for cosmetics are quite old, but contain no teaching of travel apparatus for their use.

Many attempts have been made to design a satisfactory fitted travel kit for carrying cosmetics. U.S. Pat. No. 1,555,581 to Kaiser shows a cloth article with loops for holding cosmetic items. The cloth is folded around the items and strapped in place. U.S. Pat. No. 1,281,296 to Coen shows another soft foldable toiletry kit. U.S. Pat. No. 1,900,508 to Lewis shows a traveling bag with pockets for various toiletry articles. None of the above kits was designed to stand upright during use.

U.S. Pat. No. 2,419,165 to Renz shows a box-like toilet case made of stiff leather. It contains no fitted pockets, but has an interior compartment.

U.S. Pat. No. 2,014,822 to Trachtenberg discloses a toilet kit with U-shaped hinged members which open to a generally right angle in use. The toilet kit can then stand upright for removal of items. Applying pressure to either side recloses the toilet kit.

U.S. Pat. No. 1,867,347 to Blair shows a box divided into two compartments which can be separated to stand upright for removal of toiletry articles. The box is divided into compartments for holding articles.

Cosmetics are commonly used in the home in liquid form and are dispensed by pump-type dispensers. For instance, liquid soap is now in common use in home kitchens and bathrooms. It has been difficult for the modern traveler to use this handy dispensing method because proper apparatus for transporting dispensers has not been available. A pump dispenser will eject unwanted liquids in a suitcase if the top is squeezed. Carrying individual dispensers for all the various liquid cosmetics used would result in a jumble of assorted bottles in the suitcase. This also makes for a large assortment of dispenser bottles spread over a hotel vanity.

What is needed is a compact stand for dispensing such cosmetic liquids which is easily carried in a suitcase and which conveniently holds cosmetic articles during the traveler's rest stop. The stand should hold cosmetic dispensers during their use. It must stand upright during the pumping process. Such an apparatus also must keep the dispensers from being accidentally activated in a suitcase.

SUMMARY OF THE INVENTION

A portable stand for holding toiletries includes a box portion formed by a top and a plurality of walls. The walls each have a bottom edge, and the edges form a base area upon which a box portion rests when the stand is in use. A fluid dispenser for dispensing cosmetics is mounted in the top of the box portion, with a fluid reservoir inside the box and a dispenser nozzle above the top of the box portion. The stand has a support portion movably attached to the bottom edge of one of the walls. The support portion has a bottom support plate shaped and sized generally like the base area of the box portion. The support portion has a first position, for transport, against the base area of the box portion, so that the plane of the support plate is parallel to the plane of the base area and the support portion is generally below the box portion. The support portion has a second, operating position, in which it is moved away from the base area so that the support plate extends away from and is essentially coplanar with the base area.

In a preferred embodiment, the support portion is a storage box attached to the box portion by a hinge. In one embodiment and the box portion and the storage box are made of plastic material rigid enough to stand upright and the hinge is a continuous strip of flexible plastic.

In the preferred embodiment, a cover means is removably attached to the top of the box over the dispenser nozzle when the stand is in its traveling configuration. This cover is preferably a box-shaped unit having a cover top and plurality of cover walls. This cover is preferably attached by a hinge to the top of the box portion.

The toiletry stand preferably includes a storage compartment in the box portion, which is below the fluid reservoir. A storage compartment access door in one of the walls of the box provides access to the storage compartment.

A preferred embodiment contains a plurality of fluid dispensers mounted in the box.

DETAILED DESCRIPTION OF THE PREFERRED EMBODIMENT

Figure 1:
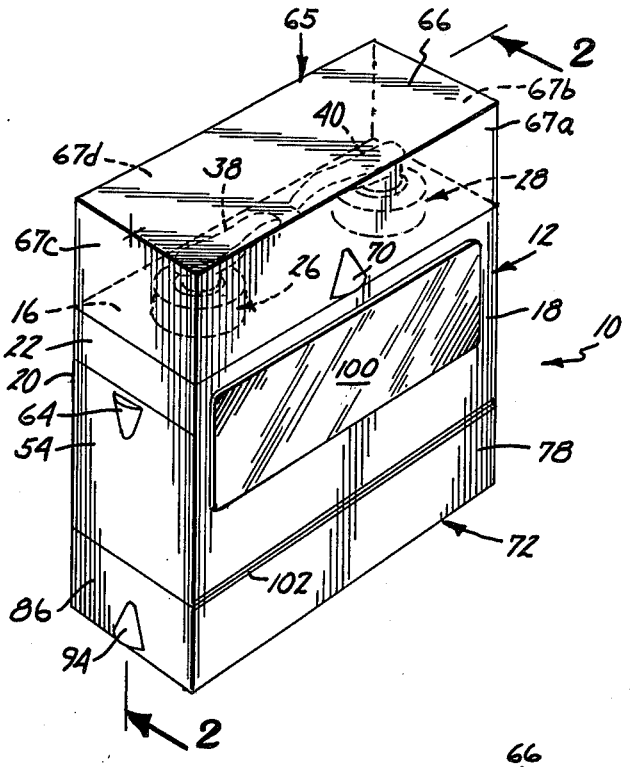
FIG. 1 is a perspective view of a portable stand for toiletries in its traveling position.

A portable toiletry stand 10 has a box portion 12 including a base wall 14, top wall 16, front wall 18, back wall 20, and first and second end walls 22 and 24. Base wall 14 is a planar area defined by the lower edges of front wall 18, back wall 20, and first and second side walls 22 and 24. Mounted in top wall 16 are dispensers 26 and 28. Dispensers 26 and 28 have reservoirs 30 and 32, respectively, which are inside box portion 12, and necks 34 and 36, respectively, which extend through and are mounted in top wall 16. Dispenser nozzles 38 and 40 of dispensers 30 and 32 are removably, threadably mounted on necks 34 and 36, respectively, by knurled rings 42 and 44, respectively. Knurled ring 42 or 44 is unscrewed to remove nozzle 38 or 40 for refilling of reservoir 30 or 32. The dispensers are standard pump dispensers now in use for liquid soaps and the like.

Below reservoirs 30 and 32 in box portion 12 and above base wall 14 is a first storage compartment 46, in which are illustrated a razor 48 and a tube of shave cream 50. Access to first storage area 46 is through opening 52 which is covered by first storage compartment door 54. First storage compartment door 54 is mounted on end wall 22 by a hinge 56 which allows door 54 to swing in the direction shown by arrow 58 in FIG. 2. Hinge 56, in the example illustrated, is a continuous strip of flexible material, such as plastic. In one preferred method of construction, box 12, door 54 and hinge 56 are molded in one integral piece and the hinge is formed in a conventional manner by reducing the thickness of the plastic along the hinge line. A boss 60 on door 54 fits into a groove 62 in first end wall 22 to latch door 54 in its closed position. A handle 64 is pulled with a fingernail to open door 54.

Figure 2:
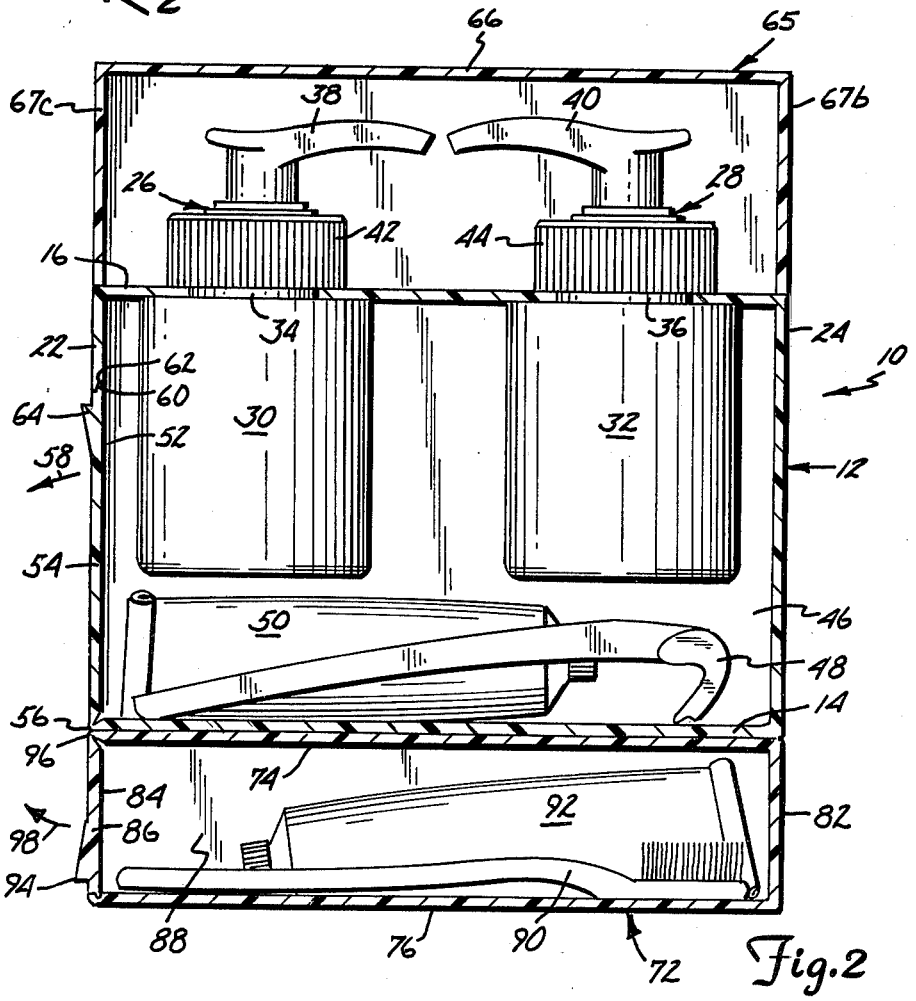
FIG. 2 in its cross-sectional view taken on line 2—2 of FIG. 1.

In FIGS. 1 and 2, stand 10 is shown in a closed traveling position. A cover 65 of generally box-shaped construction is shown enclosing the dispenser nozzles 38 and 40. Cover 65 includes a cover top 66 and cover walls 67*a*, 67*b*, 67*c*, and 67*d*. Dispenser nozzles 38 and 40 are rotatable relative to box portion 12. In the closed traveling position of FIGS. 1 and 2, the longest dimension of nozzles 38 and 40 is generally parallel to front wall 18, so that nozzles 38 and 40 may be more easily covered by cover 65. The pumps are locked when the nozzles are rotated to their closed traveling position. Usually the nozzles are depressed to pump out material from the reservoirs. Cover 65 is hingably attached by a hinge 68 at the intersection of top surface 16, back wall 20, and cover wall 67*d*. Cover 65 is equipped with a handle 70 on cover wall 67*a* for lifting cover 65 from top surface 16.

Mounted below box portion 12 is a support compartment portion 72. In the embodiment illustrated, support compartment portion 72 is a generally rectangular box with a support plate 74, a support compartment top wall 76, a back wall 78, a front wall 80, and an end wall 82. Opposite end wall 82 there is an opening 84 closed by a movable door 86. In this example, support compartment portion 72 forms a second storage compartment 88 in which are illustrated a toothbrush 90 and a tube of toothpaste 92. When the support compartment portion 72 is in position as shown in FIGS. 1 and 2, support plate 74 is generaly parallel to the planar area defined by the base wall 14 of the box portion 12. Support compartment portion 72 can be, in other embodiments, a plate or other suitable structure.

Door 86 is opened by pulling a handle 94 with a fingernail. Door 86 is attached to support plate 74 by hinge 96 so that door 86 swings in the direction shown by arrow 98 in FIG. 2.

A mirror 100 is mounted on front wall 18.

As shown in FIGS. 1 and 2, portable toiletry stand 10 is ready for insertion in a suitcase or other traveling bag. It is a neat, compact case for carrying needed toiletry items. Support compartment portion 72 is held against base wall 14 by a latch means which comprises, in this embodiment, a flexible strap 101*a* mounted on front wall 80, which has an expandable ring female snap portion 101*b*. Female snap portion 101*b* attaches to a male snap portion 101*c*, mounted on back wall 20, when stand 10 is in its traveling position.

Strap 101*a* is made of flexible plastic, molded in one piece with front wall 80, in this example. In other embodiments strap 101*a* is made of leather, cloth or other suitable material. Cover 65 prevents dispenser nozzles 38 and 40 from being accidentally activated. The stand is compact and easily portable.

Figure 3:
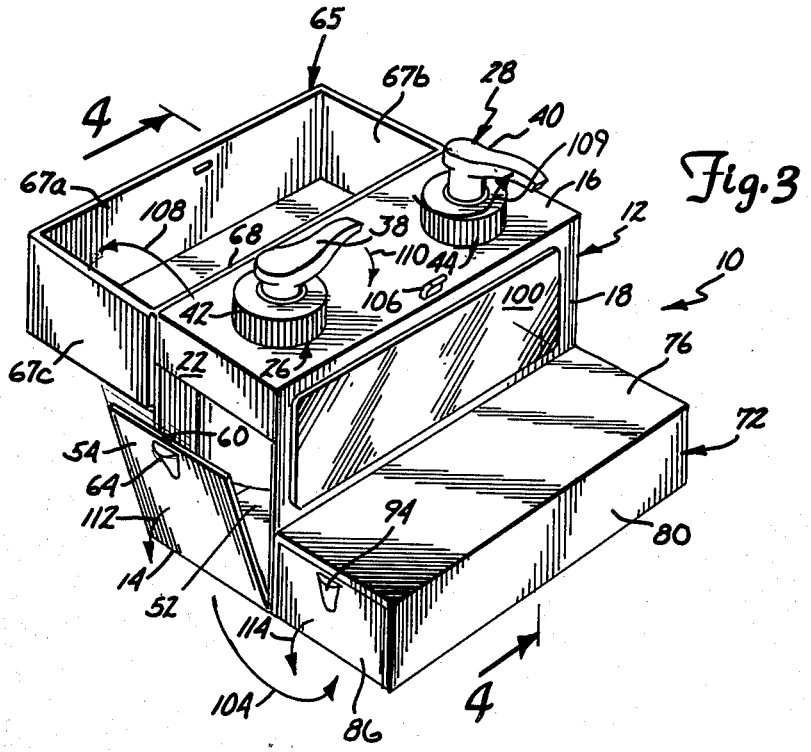
FIG. 3 is a perspective view of the stand of FIG. 1 in its open, dispensing position.
Figure 4:
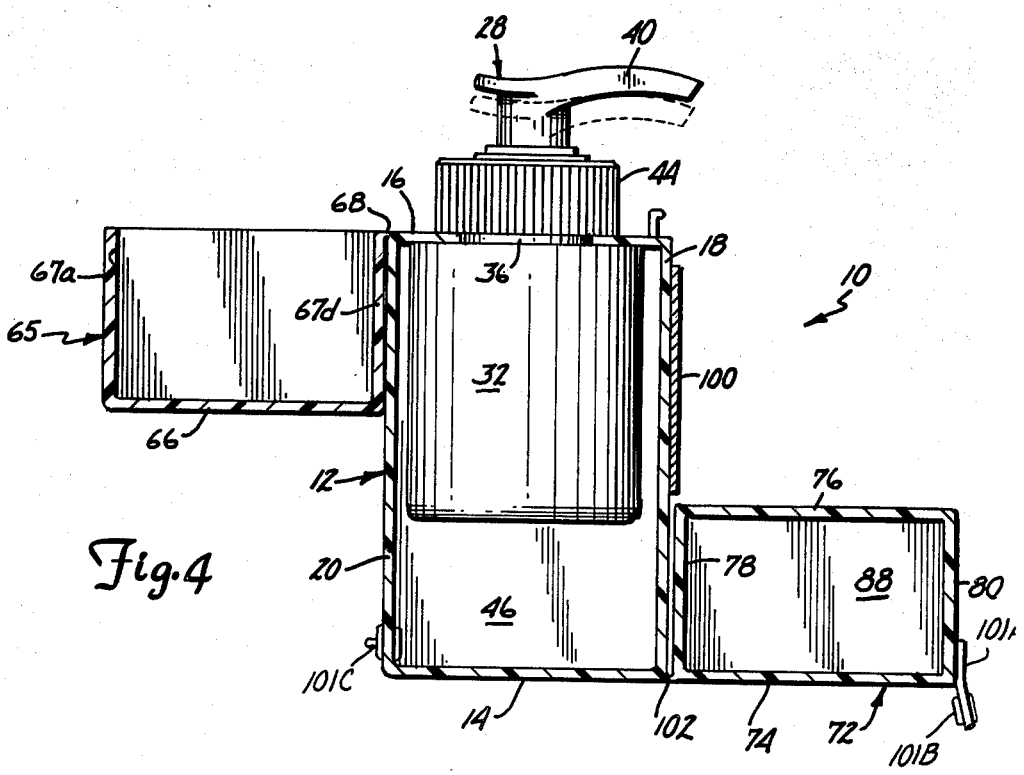
FIG. 4 is a cross-sectional view taken on line 4—4 of FIG. 3.

When the traveler arrives at his destination and desires to use cosmetics from portable stand 10, the stand is opened to a dispensing position as shown in FIGS. 3 and 4. Female snap portion 101*b* is detached from male snap portion 101*c*. Support compartment portion 72, which is hingably attached to front wall 18 by a support portion hinge 102, is swung out to a second support position, in the direction shown by arrow 104 in FIG. 3. With support compartment portion 72 in the second position, box portion 12 rests on its base wall 14 and support compartment portion 72 rests on its support plate 74. The lower surface of wall 14 and the outer surface of support plate 74 are, in this second position, essentially coplanar. Back wall 78 of support compartment portion 72 restrains front wall 18 of box portion 12 from tilting forward and provides stability. Therefore, toiletry stand 10 rests on a wide support area formed by base wall 14 and support plate 74. This provides a stable platform for dispensing cosmetics.

Cover 65 is lifted by handle 70 which disengages cover 65 from latch 106. Cover 65 is then swung in the direction shown by arrow 108 back to an open position as shown in FIG. 3. Dispenser nozzles 26 and 28 are then swung outward to a dispensing position. In FIG. 3, nozzle 40 is shown in its dispensing position after swinging as shown by arrow 109. In FIGS. 3 and 4, nozzle 40 is raised to its dispensing position, wherein depression of nozzle 40 pumps cosmetic fluid out of reservoir 32. In FIG. 4 the depressed position of nozzle 40 is shown in dotted lines. Arrow 110 shows the direction in which nozzle 38 is to be swung to its dispensing position. In this position stand 10 provides a sturdy, stable device for dispensing cosmetic liquids from dispensers 26 and 28. The support compartment portion 72 extending forward from box portion 12 resists tipping of box portion when dispensing cosmetics. In this position, doors 54 and 86 are opened downward in the directions shown by arrows 112 and 114, respectively, to allow access to first and second storage compartments 46 and 88. Mirror 100 is visible above support compartment portion 72 for shaving or applying cosmetics.

All cosmetics are stored in a neat arrangement and need not be spread around a counter or vanity. When cover 65 and doors 54 and 86 are closed, the stand 10 neatly contains all cosmetics. Everything is easily at hand without digging through a case or removing layers of tubes and cans to find a desired item, as is necessary many times in a conventional case.

Stand 10 is made from material, such as plastic, rigid enough to form a suitable dispensing stand. In the example illustrated, all the hinges 56, 68, 96 and 102 are strips of continuous flexible plastic. The case is therefore self supporting and resistant to damage by liquids.

Other combinations of dispensers and compartments in other sizes of stands constructed according to the present invention can be readily designed. The example illustrated, contains two dispensers 26 and 28 which are used, for example, for shampoo and hair conditioner. Further dispensers can be included for such things as hand lotion, liquid soap, or shaving cream. First and second storage compartments 46 and 88 can be expanded or eliminated as desired for the particular configuration. A stand constructed according to the present invention, therefore, has many variations which can suit the various cosmetic needs of travelers. Although the present invention has been described with reference to preferred embodiments, workers skilled in the art will recognize that changes may be made in form and detail without departing from the spirit and scope of the invention.

What is claimed is:

1. A portable stand for holding toiletries comprising:

a box portion with a top, first and second parallel side walls and first and second end walls joined to the side walls, each wall having a bottom edge, the bottom edges forming a base area plane;

at least one fluid dispenser mounted in the box portion through the top, each fluid dispenser having a fluid reservoir inside the box portion and a dispenser nozzle above the top; and a first tubular compartment defined by four side compartment walls and hingedly attached to a first side wall of the box portion adjacent the bottom edge thereof, one of the side compartment walls comprising a support plate generally conforming in shape and size to the base area plane of the box portion and a second side compartment wall extending generally rigidly perpendicular to the support plate, the second side compartment wall being joined to the support plate along a junction line, the hinge attachment of the first compartment to the first side wall being adjacent the junction line, and the first compartment being movable between a first position with the support plate against the base area plane of the box portion wherein the first compartment extends from the base area plane away from the box portion, the side compartment walls being substantially within the space defined by the surface of the box portion side walls with the first compartment in its first position, and a second position wherein the support plate is hinged away from the base area plane of the box portion and the plane of the support plate extends laterally from and is essentially coplanar with the base area plane and the second side compartment wall extends above the base area plane and engages and rests against said first side wall of the box portion so that the support plate supports the box portion and thereby resists tipping of the box portion in direction toward the first side wall when the box portion rrests on the base plane area and support plate.

2. The apparatus of claim 1, and further comprising cover means mountable adjacent the top of the box portion for covering the dispenser nozzle when not in use.

3. The apparatus of claim 1, and further comprising:

a second storage compartment defined in;side the box portion below the fluid reservoir; and a first access for in one end wall of the box portion for providing access to the second storage compartment.

4. The apparatus of claim 1, and further comprising latch means for securing the support plate of the support portion against the base area plane of the box portion when the support portion is in its first position.

5. The apparatus of claim 2 wherein the cover means comprises:

a cover top and a plurality of cover walls extending away from the cover top to enclose a space suitable for covering the dispenser nozzle; and a cover hinge attached to one of the cover walls on an edge thereof opposite the cover top and attached adjacent the top of the box portion.

6. The apparatus of claim 7, wherein the latch means comprises:

a first snap portion mounted on the box portion;

a flexible strap mounted on the support portion; and a second snap portion mounted on the flexible strap for removable attachment to the first snap portion.

7. A portable stand for holding toiletries comprising:

a box portion having a top and a pluraity of side walls, with each side wall having a bottom edge and the bottom edges forming a base plane area;

at least one fluid dispenser mounted in the box portion through the top thereof, with each fluid dispenser having a fluid reservoir inside the dispenser box portion and a dispenser nozzle above the top;

a first storage compartment defined inside the box portion generally below the fluid reservoir;

a first access door in one side wall of the box portion for providing access to the first storage compartment;

a support portion hingably attached to one side wall of the box portion adjacent the bottom edge thereof, the support portion having a plurality of walls to define a second storage compartment therein, a first one of the walls of the support portion being constituted as a support plate generally conforming in shape and size to the base area plane of the box portion and a second one of the walls of the support portion extending rigidly generally perpendicular to a plane defined by the support plate, third and fourth walls parallel to the first and second walls, respectively, and attached to respective edges of the second and first walls to form the second storage compartment, and the storage portion being movable between a first position against the base area plane of the box portion with the second wall being substantially coplanar with the one side wall of the box portion and the fourth side wall being substantially coplanar with a side wall of the box portion parallel to the one box portion side wall, and wherein the second compartment is below the base area plane and a second position wherein the second compartment has been hinged substantially 180° so that the plane of the support plate extends away from and is essentially coplanar with the base area plane and the second wall of the support portion engages said one side of the box portion so that the support portion and the second compartment are alongside the lower portions of the box portion and the engagement of the second wall and one side thereby resists further hinging of the support plate out of position essentially coplanar with the base area plane to provide a stable base for the box portion when the box portion rests on the base plane area and said support plate;

a second access door forming an end wall of the second compartment for providing access to the second storage compartment;

latch means for selectively securing the first wall of the support portion against the base area plane of the box portion when the support portion is in its first position; and a mirror mounted on an exterior of one side wall of the box portion in position not to be covered by the support portion when it is in its second position.

8. The apparatus of claim 7, and further comprising cover means mountable adjacent the top of the box portion for covering the dispenser nozzle when not in use.

9. The apparatus of claim 8 wherein the dispenser nozzle is movable between a first outward dispensing position wherein the nozzle extends generally horizontally past an edge of the top and a second storage position wherein the nozzle is positioned to facilitate enclosure by the cover means.

* * * * *

UNITED STATES PATENT AND TRADEMARK OFFICE

CERTIFICATE OF CORRECTION

PATENT NO. : 4,481,962

DATED : November 13, 1984

INVENTOR(S) : Richard K. Pesta

It is certified that error appears in the above-identified patent and that said Letters Patent is hereby corrected as shown below:

Column 5, line 60, (Claim 1, line 40) "rrests" should be --rests--. Column 6, line 1, (Claim 3, line 4) "for" (first occurrence) should be --door--.

Signed and Sealed this

*Twenty-first* Day of *May 1985*

[SEAL]

*Attest:*

DONALD J. QUIGG

*Attesting Officer* *Acting Commissioner of Patents and Trademarks*